US009321981B2

(12) United States Patent
Kasai

(10) Patent No.: US 9,321,981 B2
(45) Date of Patent: Apr. 26, 2016

(54) LUBRICATING OIL COMPOSITION FOR INTERNAL COMBUSTION ENGINE

(75) Inventor: Moritsugu Kasai, Chiba (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 9 days.

(21) Appl. No.: 12/918,426

(22) PCT Filed: Feb. 19, 2009

(86) PCT No.: PCT/JP2009/052902

§ 371 (c)(1),
(2), (4) Date: Oct. 11, 2010

(87) PCT Pub. No.: WO2009/104682

PCT Pub. Date: Aug. 27, 2009

(65) Prior Publication Data

US 2011/0021393 A1 Jan. 27, 2011

(30) Foreign Application Priority Data

Feb. 20, 2008 (JP) ..... 2008-038997

(51) Int. Cl.

| | |
|---|---|
| ***C10M 169/00*** | (2006.01) |
| ***C10M 169/04*** | (2006.01) |
| ***C10M 165/00*** | (2006.01) |
| ***C10M 167/00*** | (2006.01) |

(52) U.S. Cl.

CPC ..... *C10M 165/00* (2013.01); *C10M 167/00* (2013.01); *C10M 169/00* (2013.01); *C10M 169/04* (2013.01); *C10M 169/047* (2013.01); *C10M 169/048* (2013.01); *C10M 2203/1006* (2013.01); *C10M 2207/026* (2013.01); *C10M 2207/262* (2013.01); *C10M 2209/084* (2013.01); *C10M 2215/064* (2013.01); *C10M 2215/065* (2013.01); *C10M 2215/28* (2013.01); *C10M 2219/068* (2013.01); *C10M 2219/08* (2013.01); *C10M 2223/045* (2013.01); *C10M 2227/09* (2013.01); *C10N 2210/02* (2013.01); *C10N 2210/06* (2013.01); *C10N 2220/02* (2013.01); *C10N 2220/04* (2013.01); *C10N 2230/43* (2013.01); *C10N 2230/54* (2013.01); *C10N 2240/10* (2013.01)

(58) Field of Classification Search

CPC ..... C10M 165/00; C10M 167/00; C10M 169/047; C10M 169/048; C10M 2203/1006; C10M 2207/026; C10M 2207/262; C10M 2209/084; C10M 2215/064; C10M 2215/065; C10M 2215/28; C10M 2219/068; C10M 2219/08; C10M 2223/045; C10M 2227/09; C10N 2210/02; C10N 2210/06; C10N 2220/02; C10N 2220/04; C10N 2230/43; C10N 2230/54; C10N 2240/10

USPC ..... 508/287, 459

See application file for complete search history.

(56) References Cited

U.S. PATENT DOCUMENTS

| | | | | |
|---|---|---|---|---|
| 3,202,678 | A * | 8/1965 | Anderson et al. | 548/546 |
| 5,744,430 | A | 4/1998 | Inoue et al. | |
| 5,925,600 | A | 7/1999 | Atherton | |
| 2005/0153848 | A1 * | 7/2005 | Bell et al. | 508/185 |
| 2006/0148663 | A1 | 7/2006 | Shimizu | |
| 2008/0045424 | A1 | 2/2008 | Shimizu et al. | |
| 2008/0161215 | A1 | 7/2008 | Koshima et al. | |

FOREIGN PATENT DOCUMENTS

| | | | |
|---|---|---|---|
| EP | 0 562 172 | B1 | 9/1993 |
| EP | 0 719 851 | A2 | 7/1996 |
| EP | 719851 | A2 * | 7/1996 |
| EP | 1 516 910 | A1 | 3/2005 |
| EP | 1 878 784 | A1 | 1/2008 |
| EP | 2 009 084 | A1 | 12/2008 |

(Continued)

OTHER PUBLICATIONS

Extended European Search Report issued Mar. 12, 2012, in Patent Application No. 09711995.2.

(Continued)

*Primary Examiner* — Taiwo Oladapo

(74) *Attorney, Agent, or Firm* — Oblon, McClelland, Maier & Neustadt, L.L.P.

(57) ABSTRACT

The present invention provides a lubricating oil composition for internal combustion engine exhibiting excellent fuel-saving performance for a long period of time. The lubricating oil composition for internal combustion engine is characterized by containing a base oil having a kinematic viscosity as measured at 100° C. of 2 to 10 $mm^2/s$, an aromatic content (% $C_A$) of 3 or less, and a sulfur content of 300 ppm by mass or less, and the following additives: (1) an alkaline earth metal salicylate-based detergent in an amount of 0.3 to 1.5 mass % as reduced to sulfated ash; (2) a zinc dihydrocarbyldithiophosphate in an amount of 0.03 to 0.10 mass % as reduced to phosphorus; (3) a succinimide-based ashless dispersant having a molecular weight of 500 to 4,000, and an alkenyl group or an alkyl group in an amount of 0.05 to 0.20 mass % as reduced to nitrogen; (4) a phenol-based ashless antioxidant in an amount of 0.05 to 3.0 mass %; (5) an amine-based ashless antioxidant in an amount of 0.05 to 3.0 mass %; (6) a molybdenum dithiocarbamate-based friction modifier in an amount of 0.01 to 0.15 mass % as reduced to molybdenum; and optionally, (7) a viscosity index improver in an amount of 0.01 to 8 mass % as resin amount, the unit mass % being based on the total amount of the composition.

16 Claims, No Drawings

(56) References Cited

FOREIGN PATENT DOCUMENTS

| | | | |
|---|---|---|---|
| JP | 0 719 851 | A3 | 7/1996 |
| JP | 9-3463 | | 1/1997 |
| JP | 11-92778 | | 4/1999 |
| JP | 2002-12884 | | 1/2002 |
| JP | 2002-371292 | | 12/2002 |
| JP | 2007-270062 | | 10/2007 |
| WO | WO 2004/069966 | A1 | 8/2004 |
| WO | WO 2004069966 | A1 * | 8/2004 |
| WO | WO 2006/013946 | A1 | 2/2006 |
| WO | WO 2006/025246 | A1 | 3/2006 |

OTHER PUBLICATIONS

International Search Report issued May 19, 2009, in International Application No. PCT/JP2009/052902 (with English translation).
Takashi Yoshino, Sosetsu Sanka Boshizai, Junkatsu, vol. 15, No. 6, Jun. 25, 1970, pp. 312-320.
Susumu Watanabe,"Nyumon Koza Yonde Toku suru Junkatsu Tenkazai no Kiso (6) Sanka Boshizai", Journal of Japan Society of Tribologists, Feb. 15, 2008, vol. 53, No. 2, pp. 106-109.
Susumu Watanabe, Tokushu II Junkatsu Yu Tenkazai Sanka Boshizai no Gijutsu Doko, Gekkan Tribology 12 Gatsugo, Dec. 10, 2004, vol. 18, No. 12, pp. 40-43.
Communication of a notice of opposition issued Jun. 20, 2014 in European Patent Application No. 09711995.2.
M. Tanihuchi, et al., Lubricants and Special Fluids, Tribology Series 23, 1992, pp. 315-320.
ASTM International, "Standard test method for measuring friction and wear properties of lubricating grease using a high-frequency, linear-oscillation (SRV) test machine", D 5707-98, 1998, 5 Pages.
R.M. Mortier, et al., "Degradation and stabilisation of mineral oil based lubricants", Chemistry and Technology of Lubricants, 1992, pp. 106-109 with cover pages.
Theo Mang, et al., Lubricants and Lubrication, 2007, pp. 88-93.

* cited by examiner

LUBRICATING OIL COMPOSITION FOR INTERNAL COMBUSTION ENGINE

RELATED APPLICATION

This application is a national stage entry of PCT/JP2009/052902, filed Feb. 19, 2009 which is a continuation of Japanese Patent Application No. 2008-038997, filed Feb. 20, 2008, which is incorporated by reference in its entirety.

TECHNICAL FIELD

The present invention relates to a lubricating oil composition for internal combustion engine and, more particularly, to a lubricating oil composition for internal combustion engine exhibiting excellent fuel-saving performance for a long period of time.

BACKGROUND ART

In recent years, keen demand has arisen for reduction of $CO_2$ emission in order to prevent global warming. One of the most important measures for reduction of $CO_2$ emission is to improve fuel efficiency of automobiles; i.e., fuel-saving performance.

Saving of automobile fuel can be attained through reduction of the bodyweight of vehicles, improvement of combustion mechanism; e.g., employment of combustion of lean mixture, and improvement of fuel-saving performance of engine oil (lubricating oil for internal combustion engine).

The fuel-saving performance of engine oil is considered to be improved essentially through the following techniques: reducing the viscosity of engine oil so as to reduce friction loss, which is caused by lubricating oil fluid present in a fluid-lubrication area, and reducing friction generated by engine oil in order to reduce friction of sliding parts present in a mixed lubrication area.

However, when the viscosity of an engine oil is reduced excessively in an attempt to reduce friction loss caused by lubricating oil fluid, oil consumption unavoidably increases, and oil film strength decreases, resulting in a drop in wear resistance. One possible technique for reducing friction of sliding parts is incorporation of a friction reducer into engine oil. However, mere addition of a large amount of friction reducer results in insufficient friction reduction effect, or failure to maintain the reduction effect for a long period of time. Thus, at present, fuel-saving performance cannot readily be attained. In order to solve this problem, a variety of studies are underway on improvement of fuel-saving performance engine oil (see, for example, Patent Documents 1 and 2).

Patent Documents 1 and 2 disclose engine oils containing additives such as Ca salicylate, an organic molybdenum-based friction reducer, and a phenol-based antioxidant. However, the friction-reducing effect of the proposed engine oils cannot be maintained for a satisfactorily long period of time, and further improvement has been needed.

Therefore, there is demand for the development of an engine oil which exhibits excellent fuel-saving performance for a longer period of time.

Patent Document 1: Japanese Patent Application Laid-Open (kokai) No. 5-163497

Patent Document 2: Japanese Patent Application Laid-Open (kokai) No. 2002-371292

DISCLOSURE OF THE INVENTION

Problems to be Solved by the Invention

The present invention has been accomplished under such circumstances, and an object of the invention is to provide a lubricating oil composition for internal combustion engine exhibiting excellent fuel-saving performance for a long period of time.

Means for Solving the Problems

The present inventors have carried out extensive studies in order to attain the object, and have found that the object can be attained by a composition comprising a specific lube base oil into which specific additives have been incorporated. The present invention has been accomplished on the basis of this finding.

Accordingly, the present invention provides the following.

[1] A lubricating oil composition for internal combustion engine, characterized by comprising a base oil having a kinematic viscosity as measured at 100° C. of 2 to 10 $mm^2/s$, an aromatic content (% $C_A$) of 3 or less, and a sulfur content of 300 ppm by mass or less, and the following additives:

(1) an alkaline earth metal salicylate-based detergent in an amount of 0.3 to 1.5 mass % as reduced to sulfated ash;

(2) a zinc dihydrocarbyldithiophosphate in an amount of 0.03 to 0.10 mass % as reduced to phosphorus;

(3) a succinimide-based ashless dispersant having a molecular weight of 500 to 4,000, and an alkenyl group or an alkyl group in an amount of 0.05 to 0.20 mass % as reduced to nitrogen;

(4) a phenol-based ashless antioxidant in an amount of 0.05 to 3.0 mass %;

(5) an amine-based ashless antioxidant in an amount of 0.05 to 3.0 mass %;

(6) a molybdenum dithiocarbamate-based friction modifier in an amount of 0.01 to 0.15 mass % as reduced to molybdenum; and optionally, (7) a viscosity index improver in an amount of 0.01 to 8 mass % as resin amount, the unit mass % being based on the total amount of the composition.

[2] The lubricating oil composition for internal combustion engine as defined in [1] above, which further contains a molybdenum amine complex in an amount of 0.1 to 5.0 mass %.

[3] The lubricating oil composition for internal combustion engine as defined in [1] or [2] above, which contains at least one sulfur-containing compound selected from among the following components (A), (B), and (C):

component (A), which is a disulfide compound (a-1) represented by formula (V):

$$R^{12}OOC\text{-}A^1\text{-}S\text{—}S\text{-}A^2\text{-}COOR^{13} \quad (V)$$

(wherein each of $R^{12}$ and $R^{13}$ represents independently a C1 to C30 hydrocarbyl group which may have an oxygen atom, a sulfur atom, or a nitrogen atom; each of $A^1$ and $A^2$ represents independently $CR^{14}R^{15}$ or $CR^{14}R^{15}$—$CR^{16}R^{17}$; and each of $R^{14}$ to $R^{17}$ represents independently a hydrogen atom or a C1 to C20 hydrocarbyl group), and/or a disulfide compound (a-2) represented by formula (VI):

$$R^{18}OOC\text{—}CR^{20}R^{21}\text{—}CR^{22}(COOR^{19})\text{—}S\text{—}S\text{—}CR^{27}(COOR^{24})\text{—}CR^{25}R^{26}\text{—}COOR^{23} \quad (VI)$$

(wherein each of $R^{18}$, $R^{19}$, $R^{23}$, and $R^{24}$ represents independently a C1 to C30 hydrocarbyl group which may have an oxygen atom, a sulfur atom, or a nitrogen atom; and each of $R^{20}$ to $R^{22}$ and $R^{25}$ to $R^{27}$ represents independently a hydrogen atom or a C1 to C5 hydrocarbyl group);

component (B), which is a reaction product between a zinc compound and a sulfur-containing phosphoric acid ester derivative represented by formula (VII):

[F1]

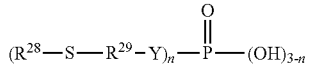

(VII)

(wherein Y represents S (sulfur) or O (oxygen), $R^{28}$ represents a C4 to C24 organic group, $R^{29}$ represents a C1 to C6 divalent organic group, and n is an integer of 1 or 2); and component (C), which is a mercaptoalkanecarboxylic acid ester zinc salt represented by formula (VIII):

$$Zn(—Sx\text{-}A^3COOR^{30})_2 \quad \text{(VIII)}$$

(wherein $R^{30}$ represents a C1 to C30 hydrocarbyl group which may have an oxygen atom, a sulfur atom, or a nitrogen atom; A represents $CR^{31}R^{32}$; each of $R^{31}$ and $R^{32}$ represents independently hydrogen or a C1 to C24 hydrocarbyl group which may have an oxygen atom, a sulfur atom, or a nitrogen atom; x is an integer of 1 or 2; and two $R^{30}$s may be identical to or different from each other, and the same applies to $A^3$ and Sx).

Effects of the Invention

According to the present invention, there can be provided a lubricating oil composition for internal combustion engine exhibiting excellent fuel-saving performance for a long period of time.

BEST MODES FOR CARRYING OUT THE INVENTION

The base oil employed in the lubricating oil composition for internal combustion engine (hereinafter the composition may be referred to simply as "lubricating oil composition") of the present invention is required to have a viscosity as measured at 100° C. of 2 to 10 $mm^2/s$, an aromatic content (% $C_A$) of 3 or less, and a sulfur content of 300 ppm by mass or less.

When the kinematic viscosity as measured at 100° C. is less than 2 $mm^2/s$, sufficient wear resistance may fail to be attained, whereas when the kinematic viscosity is in excess of 10 $mm^2/s$, fuel-saving performance may be impaired. Thus, the kinematic viscosity as measured at 100° C. is preferably 2 to 8 $mm^2/s$, more preferably 2 to 6 $mm^2/s$. When the base oil employed in the invention has an aromatic content (% $C_A$) in excess of 3, fuel-saving performance can be maintained for a limited period of time, failing to attain the object of the present invention. The aromatic content (% $C_A$) is preferably 2 or less, more preferably 1 or less, particularly preferably 0.5 or less. When the base oil employed in the invention has a sulfur content in excess of 300 ppm by mass, fuel-saving performance can be maintained for a limited period of time. Thus, the sulfur content is more preferably 100 ppm by mass or less.

Furthermore, the base oil employed in the invention preferably has a viscosity index of 90 or higher, more preferably 100 or higher, still more preferably 110 or higher. When the viscosity index is 90 or higher, the viscosity of the lubricating oil composition at low temperature can be lowered, leading to fuel saving. Also, a drop in viscosity of the composition at high temperature can be prevented, whereby lubricity at high temperature can be ensured.

No particular limitation is imposed on the base oil employed in the lubricating oil composition of the present invention, so long as the base oil satisfies the aforementioned conditions, and mineral oil and/or synthetic oil generally employed in lubricating oil can be employed.

One example of mineral base oil is a refined fraction produced through subjecting a lubricating oil fraction which has been obtained through distillation of crude oil at ambient pressure or distillation of the residue under reduced pressure, to at least one treatment selected from among solvent deasphalting, solvent extraction, hydro-cracking, hydro-dewaxing, solvent dewaxing, hydro-refining, etc. Another example of the mineral base oil is a base oil produced through isomerization of mineral oil wax or isomerization of wax (gas-to-liquid wax) produced through, for example, the Fischer-Tropsch process.

Examples of the synthetic base oil include polybutene or a hydrogenated product thereof; poly(α-olefin) such as 1-decene oligomer or a hydrogenated product thereof; diesters such as di-2-ethylhexyl adipate and di-2-ethylhexyl sebacate; polyol-esters such as trimethylolpropane caprylate and pentaerythritol 2-ethylhexanoate; aromatic synthetic oils such as alkylbenzene and alkylnaphthalene; and polyalkylene glycol and derivatives thereof.

In the present invention, a mineral base oil, a synthetic base oil, or a mixture containing two or more species thereof may be employed as a base oil. For example, one or more mineral base oils, one or more synthetic base oils, a mixture of one or more mineral base oils and one or more synthetic base oils may be employed. Among them, a mineral base oil produced through purification including hydro-cracking, and a mixture of the base oil and a hydrogenated product of poly(α-olefin) such as 1-decease oligomer are preferably employed.

In the lubricating oil composition of the present invention, an alkaline earth metal salicylate-based detergent is employed as component (1).

Typical examples of the detergent include a metal salt (neutral alkaline earth metal salicylate) produced through neutralization of an alkyl salicylate with an alkaline earth metal hydroxide or a similar compound; and a perbasic alkaline earth metal salicylate produced through perbasifying a neutral alkaline earth metal salicylate with an alkaline earth metal carbonate such as calcium carbonate. Examples of the alkaline earth metal include calcium, magnesium, and barium. Of these, calcium and magnesium are preferred, with calcium being particularly preferred.

Examples of the neutral alkaline earth metal salicylate include salicylates represented by formula (I):

[F2]

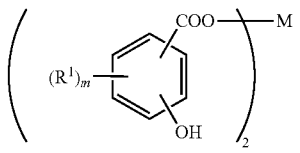

(I)

Wherein $R^1$ represents a hydrocarbyl group such as a C1 to C30 (preferably C12 to C18) alkyl group, m is an integer of 1 to 4, and M represents calcium, magnesium, or barium.

The perbasic alkaline earth metal salicylate is produced through perbasifying the aforementioned neutral alkaline earth metal salicylate.

The alkaline earth metal salicylate-based detergent employed as component (1) of the present invention is preferably has a base value (JIS K2501, perchloric acid method) of about 10 to 700 mgKOH/g. From the viewpoint of enhancement in fuel-saving performance, the base value is more preferably 100 to 500 mgKOH/g, particularly preferably 150 to 450 mgKOH/g.

The component (1) content of the lubricating oil composition of the present invention is 0.3 to 1.5 mass % as reduced to sulfated ash with respect to the total amount of the composition, preferably 0.5 to 1.2 mass %. When the component (1) content (sulfated ash content) is less than 0.3 mass %, fuel-saving performance can be maintained for only a limited time in some cases, whereas when the content is in excess of 1.5 mass %, fuel-saving performance may decrease. Both cases are not preferred.

In the lubricating oil composition of the present invention, a zinc dihydrocarbyldithiophosphate (ZnDTP) is employed as component (2). Examples of the zinc dihydrocarbyldithiophosphate include compounds represented by formula (II):

[F3]

(II)

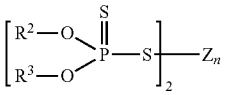

Wherein each of $R^2$ and $R^3$ represents independently a C3 to C18 hydrocarbyl group. The hydrocarbyl group is preferably a primary or secondary alkyl group, or an alkylaryl group having a C3 to C12 alkyl substituent.

Examples of the C3 to C18 primary or secondary alkyl group include primary and secondary propyl groups, butyl groups, pentyl groups, hexyl groups, octyl groups, decyl groups, dodecyl groups, tetradecyl groups, hexadecyl groups, and octadecyl groups. Examples of the alkylaryl group having a C3 to C12 alkyl substituent include propylphenyl, pentylphenyl, octylphenyl, nonylphenyl, and dodecylphenyl.

In the lubricating oil composition of the present invention, these zinc dihydrocarbyldithiophosphates serving as component (2) may be used singly or in combination of two or more species. Of these, a zinc dialkyldithiophosphate whose alkyl groups are mainly formed of secondary alkyl groups is preferred, from the viewpoint of enhancement in wear resistance.

The zinc dihydrocarbyldithiophosphate (component (2)) content of the lubricating oil composition of the present invention falls within a range of 0.03 to 0.20 mass % as reduced to P. When the P content is 0.03 mass % or more, good wear resistance can be attained, and the effect of prolongation of fuel-saving performance can be enhanced, whereas when the P content is 0.20 mass % or less, catalyst poisoning of an exhaust gas converter catalyst can be suppressed. The zinc dihydrocarbyldithiophosphate content (as P) is preferably 0.05 to 0.15 mass %, more preferably 0.07 to 0.12 mass %.

In the lubricating oil composition of the present invention, a succinimide-based ashless dispersant having a molecular weight of 600 to 4,500 and an alkenyl group or an alkyl group is employed as component (3). Examples of such succinimide-based ashless dispersants include mono-type alkenyl- or alkylsuccinimides represented by formula (III-a), bis-type alkenyl- or alkylsuccinimides represented by formula (III-b), and/or boron derivatives thereof, and/or organic acid-modified products thereof.

[F4]

(III-a)

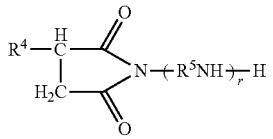

(III-b)

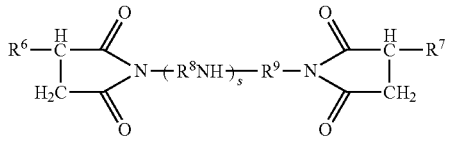

Wherein each of $R^4$, $R^6$, and $R^7$ represents an alkenyl group or an alkyl group having a number average molecular weight of 500 to 4,000 (preferably 800 to 3,000); $R^6$ and $R^7$ may be identical to or different from each other; each of $R^5$, $R^8$, and $R^9$ represents a C2 to C5 alkylene group; $R^8$ and $R^9$ may be identical to or different from each other; r is an integer of 1 to 10 (preferably 2 to 6); and s is an integer of 1 to 9 (preferably 1 to 5).

Examples of the alkenyl group of $R^4$, $R^6$, and $R^7$ include a polybutenyl group and a polyisobitenyl group, and examples of the alkyl group include a hydrogenated polybutenyl group and a hydrogenated polyisobitenyl group.

Generally, the succinimide having an alkenyl or alkyl group may be produced through reaction of polyamine with an alkenylsuccinic anhydride, which is produced through reaction between polyolefin and maleic anhydride, or with an alkylsuccinic anhydride, which is produced through hydrogenation of an alkenylsuccinic anhydride. Selection of monotype and bis-type of the succinimide can be made by modifying the ratio of alkenylsuccinic anhydride or alkylsuccinic anhydride to polyamine in reaction.

Examples of the polyamine include monoalkylenediamines such as ethylenediamine, propylenediamine, butylenediamie, and pentylenediamine; and polyalkylenepolyamines such as diethylenetriamine, triethylenetetramine, tetraethylenepentamine, pentaethylenehexamine, di(methylethylene)triamine, dibutylenetriamine, tributylenetetramine, and pentapentylenehexamine.

In the present invention, a boron derivative of the aforementioned alkyenyl- or alkylsuccinimide compound may be employed as component (3). The boron derivative may be produced through, for example, reacting the aforementioned polyolefin with maleic anhydride, to thereby form an alkenylsuccinic anhydride; and reacting the alkenylsuccinic anhydride with an intermediate produced from the aforementioned polyamine with a boron compound such as boron oxide, boron halide, boric acid, boric anhydride, borate ester, or a boronic acid ammonium salt, for imidation.

The boron content of the boron derivative is generally 0.05 to 5 mass %.

In the lubricating oil composition of the present invention, the aforementioned alkenyl- or alkylsuccinimide compounds may be used, as component (3), singly or in combination of two or more species.

The component (3) content of the lubricating oil composition of the present invention is 0.05 to 0.20 mass % as reduced to nitrogen with respect to the total amount of the lubricating oil composition. When the component (3) content is less than 0.05 mass %, sufficient fuel-saving performance may fail to be attained, whereas when the content in excess of 0.20 mass %, a rubber sealing agent is undesirably impaired.

In the lubricating oil composition of the present invention, a phenol-based ashless antioxidant is employed as component (4). Typical examples of preferred phenol-based antioxidants include 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,4-dimethyl-6-tert-butylphenol, 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl) sulfide, bis(3,5-di-tert-butyl-4-hydroxybenzyl) sulfide, 2,2'-thio-diethylenebis[3-(3,5-di-tert-butyl-4-hydroxyphenyl) propionate], tridecyl-3-(3,5-di-tert-butyl-4-hydroxyphenyl) propionate, pentaerythrityl-tetrakis[3-(3,5-di-tert-butyl-4-hydroxyphenyl) propionate], octyl-3-(3,5-di-tert-butyl-4-hydroxyphenyl) propionate, octadecyl-3-(3,5-di-tert-butyl-4-hydroxyphenyl) propionate, and octyl-3-(3-methyl-5-tert-butyl-4-hydroxyphenyl) propionate. Of these, bisphenol-based antioxidants and ester-group-containing phenol-based antioxidants are more preferred from the viewpoint of antioxidation effect.

In the present invention, the aforementioned phenol-based antioxidants may be used, as component (4), singly or in combination of two or more species. The component (4) content of the lubricating oil composition of the present invention is 0.05 to 3.0 mass % (preferably 0.2 to 2.0 mass %) with respect to the total amount of the lubricating oil composition. When the component (4) content is less than 0.05 mass %, fuel-saving performance can be maintained, in some cases, for an unsatisfactorily short period, whereas the content is in excess of 3.0 mass %, a remarkable effect in antioxidation effect cannot be attained, which is not preferred in economy.

In the lubricating oil composition of the present invention, an amine-based ashless antioxidant is employed as component (5). Typical examples of the amine-based antioxidant include a diphenylamine-based antioxidant and a naphthylamine-based antioxidant. Specific examples of the diphenylamine-based antioxidant include diphenylamine and alkylated diphenylamines having a C3 to C20 alkyl group such as monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine, and tetranonyldiphenylamine. Specific examples of the naphthylamine-based antioxidant include α-naphthylamine and C3 to C20 alkyl-substituted phenyl-α-naphthylamines such as phenyl-α-naphthylamine, butylphenyl-α-naphthylamine, hexylphenyl-α-naphthylamine, octylphenyl-α-naphthylamine, and nonylphenyl-α-naphthylamine. Of these, diphenylamine-based antioxidants are more preferred than naphthylamine-based antioxidants, from the viewpoint of antioxidation effect. Particularly, alkylated diphenylamines having a C3 to C20 alkyl group, inter alia, 4,4'-di($C_3$ to $C_{20}$ alkyl)diphenylamine, are preferred.

In the present invention, the aforementioned amine-based antioxidants may be used, as component (5), singly or in combination of two or more species. In the present invention, from the viewpoints of antioxidation effect and cost, the component (5) content is 0.05 to 3.0 mass % with respect to the total amount of the lubricating oil composition, preferably 0.2 to 2.0 mass %. When the component (5) content is less than 0.05 mass %, fuel-saving performance cannot sufficiently last, whereas when the content is in excess of 3.0 mass %, a further enhance antioxidation effect commensurate with the excess amount is not expected.

In the present invention, the aforementioned phenol-based ashless antioxidant (component (4)) and amine-based antioxidant (component (5)) must be used in combination. Through incorporation of the two components into the composition, a remarkably excellent synergistic effect on long-lasting fuel-saving performance can be attained, as compared with the case in which only one of the two components has been incorporated.

The total amount of components (4) and (5) is preferably 0.3 to 4.0 mass %, more preferably 0.5 to 3.0 mass %.

In the lubricating oil composition of the present invention, a molybdenum dithiocarbamate-based friction modifier is employed as component (6).

Examples of the molybdenum dithiocarbamate (MoDTC) molybdenum oxysulfide dithiocarbamates represented by formula (IV):

[F5]

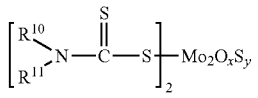

(IV)

Wherein each of $R^{10}$ and $R^{11}$ represents a C4 to C24 hydrocarbyl group, each of x and y is a number of 1 to 3, and the sum of x and y is 4.

Examples of the C4 to C24 hydrocarbyl group include a C4 to C24 alkyl group, a C4 to C24 alkenyl group, a C6 to C24 aryl group, and a C7 to C24 arylalkyl group.

The C4 to C24 alkyl group or the C4 to C24 alkenyl group may be linear, branched, or cyclic. Specific examples include n-butyl, isobutyl, sec-butyl, tert-butyl, hexyls, octyls, decyls, dodecyls, tetradecyls, hexadecyls, octadecyls, icosyls, cyclopentyl, cyclohexyl, oleyl, and linoleyl. The aforementioned C6 to C24 aryl group or C7 to C24 arylalkyl group may have one or more substituents on the aromatic ring thereof. Examples of such substituents include phenyl, tolyl, xylyl, naphtyl, butylpheneyl, octylphenyl, nonylphenyl, benzyl, methylbenzyl, butylbenzyl, phenethyl, methylphenethyl, and butylphenethyl.

Typical examples of the molybdenum dithiocarbamate-based friction reducer serving as component (6) include molybdenum sulfide diethyldithiocarbamate, molybdenum sulfide diproyldithiocarbamate, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, molybdenum sulfide ditridecyldithiocarbamate, molybdenum sulfide di(butylphenyl)dithiocarbamate, molybdenum sulfide di(nonylphenyl)dithiocarbamate, molybdenum oxysulfide diethyldithiocarbamate, molybdenum oxysulfide dipropyldithiocarbamate, molybdenum oxysulfide dibutyldithiocarbamate, molybdenum oxysulfide dipentyldithiocarbamate, molybdenum oxysulfide dihexyldithiocarbamate, molybdenum oxysulfide dioctyldithiocarbamate, molybdenum oxysulfide didecyldithiocarbamate, molybdenum oxysulfide didodecyldithiocarbamate, molybdenum oxysulfide ditridecyldithiocarbamate, molybdenum oxysulfide di(butylphenyl)dithiocarbamate, and molybdenum oxysulfide di(nonylphenyl)dithiocarbamate.

In the present invention, the aforementioned molybdenum dithiocarbamate-based friction modifiers may be used, as component (6), singly or in combination of two or more species. In the present invention, the component (6) content is 0.01 to 0.15 mass % as reduced to molybdenum, preferably 0.02 to 0.10 mass %. When the component (6) content is less than 0.01 mass %, sufficient fuel-saving performance may fail to be attained, whereas when the content is in excess of 0.15 mass %, further enhancement in effects cannot be expected.

To the lubricating oil composition of the present invention, a viscosity index improver may be employed as component (7) in accordance with needs.

Through incorporation of a viscosity index improver, the viscosity index of a lubricating oil can be further enhanced. In this case, even when a low-viscosity base oil is employed in order to further enhance fuel-saving performance, a drop in viscosity at high temperature can be suppressed, and wear resistance can be ensured. Therefore, when a base oil having a considerably low kinematic viscosity or an insufficient viscosity index is employed, a viscosity index improver is preferably incorporated into a lubricating oil composition. No particular limitation is imposed on the viscosity index improver, and examples thereof include polymethacrylate (PMA), olefin copolymer (OCP), polyalkylstyrene (PAS), and styrene-diene copolymer (SCP). Among them, at least one polymer selected from among polymethacrylate, styrene-isoprene copolymer, and ethylene-α-olefin copolymer each having a weight average molecular weight of 100,000 to 800,000, preferably 150,000 to 600,000 is particularly preferably added to a lubricating oil composition. These viscosity index improvers are employed in order to adjust the kinematic viscosity (100° C.) to fall within a target range of, for example, about 5 to about 12 $mm^2/s$ or about 4 to about 9 $mm^2/s$. Therefore, the amount of a viscosity index improver(s) added to the composition is 0.01 to 8 mass % as reduced to resin amount with respect to the amount of the composition, preferably 0.02 to 6 mass %.

To the lubricating oil composition of the present invention, a molybdenum amine complex (component (8)) may be further added.

The molybdenum amine complex employed in the invention may be a hexa-valent molybdenum compound, specifically a reaction product of an amine compound and molybdenum trioxide and/or molybdic acid or a compound produced through a production method disclosed in, for example, Japanese Patent Application Laid-Open (kokai) No. 2003-252887.

Examples of the amine compound to be reacted with the hexa-valent molybdenum compound include monoalkyl- or monoalkenylamines such as hexylamine, (secondary hexyl) amine, octylamine, (secondary octyl)amine, 2-ethylhexylamine, decylamine, (secondary decyl)amine, dodecylamine, (secondary dodecyl)amine, tetradecylamine, (secondary tetradecyl)amine, hexadecylamine, (secondary hexadecyl) amine, octadecylamine, (secondary octadecyl)amine, and oleylamine; secondary amines such as N-hexylmethylamine, N-(secondary hexyl)methylamine, N-cyclohexylmethylamine, N-2-ethylhexylmethylamine, N-(secondary octyl)methylamine, N-decylmethylamine, N-(secondary decyl)methylamine, N-dodecylmethylamine, N-(secondary dodecyl) methylamine, N-tetradecylmethylamine, N-hexadecylmethylamine, N-stearylmethylamine, N-oleylmethylamine, dibutylamine, di(secondary butyl)amine, dihexylamine, di(secondary hexyl)amine, dibenzylamine, dioctylamine, bis(2-ethylhexyl)amine, di(secondary octyl) amine, didecylamine, di(secondary decyl)amine, didodecylamine, di(secondary dodecyl)amine, ditetradecylamine, dihexadecylamine, distearylamine, dioleylamine, bis(2-hexyldecyl)amine, bis(2-octyldodecyl)amine, and bis(2-decyltetradecyl)amine;

N-alkyl- or N-alkenyldiamines such as N-butylethylenediamine, N-octylethylenediamine, N-(2-ethylhexyl)ethylenediamine, N-dodecylethylenediamine, N-octadecylethylenediamine, N-butyl-1,3-propanediamine, N-octyl-1,3-propanediamine, N-(2-ethylhexyl)-1,3-propanediamine, N-decyl-1,3-propanediamine, N-dodecyl-1,3-propanediamine, N-tetradecyl-1,3-propanediamine, N-hexadecyl-1,3-propanediamine, N-octadecyl-1,3-propanediamine, N-oleyl-1,3-propanediamine, N-butyl-1,6-hexylenediamine, N-octyl-1,6-hexylenediamine, N-(2-ethylhexyl)-1,6-hexylenediamine, N-dodecyl-1,6-hexylenediamine, N-octadecyl-1,6-hexylenediamine, and N-oleyl-1,6-hexylenediamine;

N-alkyl or N-alkenylmonoethanolamines such as N-hexylmonoethanolamine, N-octylmonoethanolamine, N-decylmonoethanolamine, N-dodecylmonoethanolamine, N-tetradecylmonoethanolamine, N-hexadecylmonoethanolamine, N-octadecylmonoethanolamine, and N-oleylmonoethanolamine; 2-hydroxyalkyl primary amines such as 2-hydroxyhexylamine, 2-hydroxyoctylamine, 2-hydroxydecylamine, 2-hydroxydodocylamine, 2-hydroxytetradecylamine, 2-hydroxyhexadecylamine, and 2-hydroxyoctadecylamine; and N-2-hydroxyalkyl secondary amines such as N-2-hydroxyhexylmethylamine, N-2-hydroxyoctylmethylamine, N-2-hydroxydecylmethylamine, N-2-hydroxytetradecylmethylamine, N-2-hydroxyhexadecylmethylamine, N-2-hydroxyoctadecylmethylamine, N-2-hydroxyhexylethylamine, N-2-hydroxyoctylethylamine, N-2-hydroxydecylethylamine, N-2-hydroxytetradecylethylamine, N-2-hydroxyhexadecylethylamine, N-2-hydroxyoctadecylethylamine, N-2-hydroxyhexylbutylamine, N-2-hydroxyoctylbutylamine, N-2-hydroxydecylbutylamine, N-2-hydroxytetradecylbutylamine, N-2-hydroxyhexadecylbutylamine, N-2-hydroxyoctadecylbutylamine, N-2-hydroxyhexylmonoethanolamine, N-2-hydroxyoctylmonoethanolamine, N-2-hydroxydecylmonoethanolamine, N-2-hydroxytetradecylmonoethanolamine, N-2-hydroxyhexadecylmonoethanolamine, N-2-hydroxyoctadecylmonoethanolamine, bis(2-hydroxyoctyl) amine, bis(2-hydroxydecyl)amine, bis(2-hydroxydodecyl) amine, bis(2-hydroxytetradecyl)amine, bis(2-hydroxyhexadecyl)amine, and bis(2-hydroxyoctadecyl) amine.

These amine compounds may be used singly or in combination of two or more species.

The ratio by mole of the aforementioned hexa-valent molybdenum compound to that of the amine compound in the reaction is preferably 0.7 to 5 (Mo atoms in the molybdenum compound with respect to 1 mole of amine compound), more preferably 0.8 to 4, still more preferably 1 to 2.5. No particular limitation is imposed on the reaction format, and a known method, for example a method disclosed in Japanese Patent Application Laid-Open (kokai) No. 2003-252887, may be employed.

In the present invention, the aforementioned molybdenum amine complex is preferably employed in an amount of 0.1 to 5 mass % with respect to the total amount of the lubricating oil. When the amount of the complex is 0.1 mass % or more, fuel-saving performance can be maintained for a further prolonged period of time, whereas when the amount is 5 mass % or less, a stable lubricating oil composition can be produced without impeding dissolution of the complex. More preferably, the amount of the complex is 0.1 to 1 mass %.

The lubricating oil composition of the present invention comprises a specific base oil and components (1) to (6), components (1) to (7), or components (1) to (8). The composition may further contain one or more sulfur-containing compounds selected from the following (A) to (C):

(A) a disulfide compound (B) a reaction product between a sulfur-containing phosphoric acid ester derivative and a zinc compound, and (C) a mercaptoalkanecarboxylic acid ester zinc salt.

The disulfide compound employed as component (A) is at least one species selected from among disulfide compounds (a-1) represented by formula (V):

$$R^{12}OOC\text{-}A^{1}\text{-}S\text{—}S\text{-}A^{2}\text{-}COOR^{13} \quad (V)$$

and/or disulfide compounds (a-2) represented by formula (VI):

$$R^{18}OOC\text{—}CR^{20}R^{21}\text{—}CR^{22}(COOR^{19})\text{—}S\text{—}S\text{—}CR^{27}(COOR^{24})\text{—}CR^{25}R^{26}\text{—}COOR^{23} \quad (VI).$$

In the above formula (V), each of $R^{12}$ and $R^{13}$ represents independently a C1 to C30 hydrocarbyl group, preferably a C1 to C20, more preferably a C2 to C18, particularly C3 to C18 hydrocarbyl group. The hydrocarbyl group may be linear, branched, or cyclic, and may contain an oxygen atom, sulfur atom, or a nitrogen atom. $R^{12}$ and $R^{13}$ may be identical to or different from each other. For a production-related reason, the two groups are preferably identical to each other.

Each of $A^1$ and $A^2$ represents independently $CR^{14}R^{15}$ or $CR^{14}R^{15}$—$CR^{16}R^{17}$, wherein each of $R^{14}$ to $R^{17}$ represents independently a hydrogen atom or a C1 to C20 hydrocarbyl group. The hydrocarbyl group is preferably a C1 to C12 hydrocarbyl group, more preferably a C1 to C8 hydrocarbyl group. $A^1$ and $A^2$ may be identical to or different from each other. For a production-related reason, the two groups are preferably identical to each other.

Examples of the method for producing a disulfide compound represented by formula (V) include oxidative coupling of a mercaptoalkanecarboxylic acid ester. In the coupling, oxygen, hydrogen peroxide, dimethyl sulfoxide, or the like is employed as an oxidizing agent.

In the above formula (VI), each of $R^{16}$, $R^{19}$, $R^{23}$, and $R^{24}$ represents independently a C1 to C30 hydrocarbyl group, preferably a C1 to C20, more preferably a C2 to C18, particularly C3 to C18 hydrocarbyl group. The hydrocarbyl group may be linear, branched, or cyclic, and may contain an oxygen atom, sulfur atom, or a nitrogen atom. $R^{18}$, $R^{19}$, $R^{23}$, and $R^{24}$ may be identical to or different from one another. For a production-related reason, the two groups are preferably identical to one another.

Each of $R^{20}$ to $R^{22}$ and $R^{25}$ to $R^{27}$ represents independently a hydrogen atom or a C1 to C5 hydrocarbyl group. Among them, a hydrogen atom is preferred, since the material therefor is highly available.

One method for producing a disulfide compound represented by formula (VI) includes oxidative coupling of a mercaptoalkanedicarboxylic acid diester, and esterifying the coupling product with a monohydric alcohol formed from a C1 to C30 hydrocarbyl group optionally having an oxygen atom, sulfur atom, or a nitrogen atom.

Specific examples of the disulfide compound represented by formula (V) include bis(methoxycarbonylmethyl) disulfide, bis(ethoxycarbonylmethyl) disulfide, bis(n-propoxycarbonylmethyl) disulfide, bis(isopropoxycarbonylmethyl) disulfide, bis(n-butoxycarbonylmethyl) disulfide, bis(n-octoxycarbonylmethyl) disulfide, bis(n-dodecyloxycarbonylmethyl) disulfide, bis(cyclopropoxycarbonylmethyl) disulfide, 1,1-bis(1-methoxycarbonylethyl) disulfide, 1,1-bis(1-methoxycarbonyl-n-propyl) disulfide, 1,1-bis(1-methoxycarbonyl-n-butyl) disulfide, 1,1-bis(1-methoxycarbonyl-n-hexyl) disulfide, 1,1-bis(1-methoxycarbonyl-n-octyl) disulfide, 1,1-bis(1-methoxycarbonyl-n-dodecyl) disulfide, 2,2-bis(2-methoxycarbonyl-n-propyl) disulfide, α,α-bis(α-methoxycarbonylbenzyl) disulfide, 1,1-bis(2-methoxycarbonylethyl) disulfide, 1,1-bis(2-ethoxycarbonylethyl) disulfide, 1,1-bis(2-n-propoxycarbonylethyl) disulfide, 1,1-bis(2-isopropoxycarbonylethyl) disulfide, 1,1-bis(2-cyclopropoxycarbonylethyl) disulfide, 1,1-bis(2-methoxycarbonyl-n-propyl) disulfide, 1,1-bis(2-methoxycarbonyl-n-butyl) disulfide, 1,1-bis(2-methoxycarbonyl-n-hexyl) disulfide, 1,1-bis(2-methoxycarbonyl-n-propyl) disulfide, 2,2-bis(3-methoxycarbonyl-n-pentyl) disulfide, and 1,1-bis(2-methoxycarbonyl-1-phenylethyl) disulfide.

Specific examples of the disulfide compound represented by formula (VI) include tetramethyldithiomalate, tetraethyl dithiomalate, tetra-1-propyl dithiomalate, tetra-2-propyl dithiomalate, tetra-1-butyl dithiomalate, tetra-2-butyl dithiomalate, tetraisobutyl dithiomalate, tetra-1-hexyl dithiomalate, tetra-1-octyl dithiomalate, tetra-1-(2-ethyl)hexyl dithiomalate, tetra-1-(3,5,5-trimethyl)hexyl dithiomalate, tetra-1-decyl dithiomalate, tetra-1-dodecyl dithiomalate, tetra-1-hexadecyl dithiomalate, tetra-1-octadecyl dithiomalate, tetrabenzyl dithiomalate, tetra-α-(methyl)benzyl dithiomalate, tetra-α,α-dimethylbenzyl dithiomalate, tetra-1-(2-methoxy)ethyl dithiomalate, tetra-1-(2-ethoxy)ethyl dithiomalate, tetra-1-(2-butoxy)ethyl dithiomalate, tetra-1-(2-ethoxy)ethyl dithiomalate, tetra-1-(2-butoxy-butoxy)ethyl dithiomalate, and tetra-1-(2-phenoxy)ethyl dithiomalate.

As component (B), at least one species selected from reaction products between a sulfur-containing phosphoric acid ester derivative and a zinc compound is employed.

Examples of the phosphoric acid ester derivative include compounds represented by formula (VII):

[F6]

$$(R^{28}\text{—}S\text{—}R^{29}\text{-}Y)_n\text{—}\overset{\overset{\displaystyle O}{\|}}{P}\text{—}(OH)_{3-n} \quad (VII)$$

Wherein Y represents S (sulfur) or O (oxygen), $R^{28}$ represents a C4 to C24 organic group, $R^{29}$ represents a C1 to C6 divalent organic group, and n is an integer of 1 or 2.

The organic group $R^{28}$ is preferably a C4 to C24 hydrocarbyl group. Specifically, an alkyl group, a cycloalkyl group, an aryl group, an arylalkyl group, or the like is employed. Of these, a C8 to C16 alkyl group is particularly preferred.

In formula (VII), $R^{29}$ is preferably a C1 to C6 hydrocarbyl group, particularly preferably a C1 to C4 alkylene group. Specific examples include divalent aliphatic groups such as methylene, ethylene, 1,2-propylene, 1,3-propylene, butylenes, pentylenes, and hexylenes; alicyclic group having two bonding sites in the alicyclic hydrocarbon such as cyclohexane or methylcyclopentane; and phenylenes.

Y represents S (sulfur) or O (oxygen). Thus, the compound represented by formula (VII) has at least one S. The numeral "n" is an integer of 1 or 2.

Specific examples of the sulfur-containing phosphoric acid ester derivative represented by formula (VII) include hydrogen di(hexylthioethyl)phosphate, hydrogen di(octylthioethyl)phosphate, hydrogen di(dodecylthioethyl)phosphate, hydrogen di(hexadecylthioethyl)phosphate, hydrogen mono (hexylthioethyl)phosphate, hydrogen mono(octylthioethyl) phosphate, hydrogen mono(dodecylthioethyl)phosphate, and hydrogen mono(hexadecylthioethyl)phosphate.

The sulfur-containing phosphoric acid ester derivative represented by formula (VII) may be produced through, for example, reaction between alkylthioalkyl alcohol or alkylthioalkoxide and phosphorus oxychloride ($POCl_3$) in the absence of catalyst or in the presence of a base.

Examples of preferred zinc compounds employed in the reaction between the sulfur-containing phosphoric acid ester derivative and the zinc compound include metallic zinc, zinc oxide, organic zinc compounds, zinc oxyacid salts, zinc halides, and zinc complexes. Specific examples include zinc, zinc oxide, zinc hydroxide, zinc chloride, zinc carbonate, zinc carboxylates, and zinc complexes.

The reaction between the sulfur-containing phosphoric acid ester derivative and the zinc compound may be performed in the absence or presence of a catalyst. In this reaction, the amount of sulfur-containing phosphoric acid ester derivative with respect to that of zinc compound is generally 0.1 to 5.0 mol with respect to 1 mol of zinc compound, preferably 1 to 3 mol, more preferably 1.5 to 2.5 mol. The reaction temperature generally falls within a range of room temperature to 200° C., preferably a range of 40 to 150° C.

The thus-obtained reaction product is predominantly formed of a sulfur-containing phosphoric acid ester zinc salt, and the crude product is purified through a routine method to thereby remove impurities. The thus-purified product is employed as the sulfur-containing phosphoric acid ester zinc salt.

The mercaptoalkanecarboxylic acid ester zinc salt serving as component (C) includes compound represented by, for example, formula (VIII):

$$Zn—(Sx\text{-}A^3\text{-}COOR^{30})_2 \quad \text{(VIII)}$$

Wherein $R^{30}$ represents a C1 to C30 hydroxycarbyl group optionally having an oxygen atom, a sulfur atom, or nitrogen atom; $A^3$ represents $CR^{31}R^{32}$; each of $R^{31}$ and $R^{32}$ represents independently hydrogen or a C1 to C24 hydroxycarbyl group optionally having an oxygen atom, a sulfur atom, or nitrogen atom; x is 1 or 2; and two of $R^{30}$s, two of $A^3$s, or two of Sxs may be identical to or different from each other.

Typical examples of the mercaptoalkanecarboxylic acid ester zinc salt include bis(methyl mercaptomethanecarboxylate) zinc salt, bis(ethyl mercaptomethanecarboxylate) zinc salt, bis(n-propyl mercaptomethanecarboxylate) zinc salt, bis (isopropyl mercaptomethanecarboxylate) zinc salt, bis(n-butyl mercaptomethanecarboxylate) zinc salt, bis(n-octyl mercaptomethanecarboxylate) zinc salt, bis(2-ethylhexyl mercaptomethanecarboxylate) zinc salt, bis(dodecyl mercaptomethanecarboxylate) zinc salt, bis(hexadecyl mercaptomethanecarboxylate) zinc salt, bis(octadecyl mercaptomethanecarboxylate) zinc salt, bis(methyl mercaptoethanecarboxylate) zinc salt, bis(ethyl mercaptoethanecarboxylate) zinc salt, bis(n-propyl mercaptoethanecarboxylate) zinc salt, bis(isopropyl mercaptoethanecarboxylate) zinc salt, bis(n-butyl mercaptoethanecarboxylate) zinc salt, bis(n-octyl mercaptoethanecarboxylate) zinc salt, bis(2-ethylhexyl mercaptoethanecarboxylate) zinc salt, bis(dodecyl mercaptoethanecarboxylate) zinc salt, bis(hexadecyl mercaptoethanecarboxylate) zinc salt, and bis(octadecyl mercaptoethanecarboxylate) zinc salt.

In one embodiment of the group $CR^{31}R^{32}$ represented by $A^3$, $R^{31}$ is hydrogen or a C1 to C8 hydroxycarbyl group optionally having an oxygen atom, a sulfur atom, or nitrogen atom, and $R^{32}$ is ($CH_2COOR^3$). $R^{33}$ represents a C1 to C30 hydroxycarbyl group optionally having an oxygen atom, a sulfur atom, or nitrogen atom. Typical examples of the mercaptoalkanecarboxylic acid ester zinc salt include zinc salts of dimethyl mercaptomalate, diethyl mercaptomalate, di-n-propyl mercaptomalate, diisopropyl mercaptomalate, di-n-butyl mercaptomalate, di-n-octyl mercaptomalate, 2-ethylhexyl mercaptomalate, didodecyl mercaptomalate, dihexadecyl mercaptomalate, dioctadecyl mercaptomalate, etc.

The composition of the present invention may further contain one or more sulfur-containing compounds selected from (A) to (C). Generally, the amount of the sulfur-containing compounds incorporated into the composition is preferably 0.005 to 5 mass %, more preferably 0.1 to 4 mass %. When the amount is 0.005 mass % or more, fuel-saving performance can be maintained for a longer period of time, whereas when the amount is 5 mass % or less, corrosion can be prevented.

So long as the objects of the invention are not impaired, the lubricating oil composition of the present invention may further contain additives in accordance with needs.

Examples of such additives include metallic detergents other than component (1); antioxidants such as phosphorus-containing antioxidants; antiwear agents and extreme pressure agents other than components (2), (6), and (A) to (C), specifically, sulfur compounds (e.g., sulfides, sulfoxides, sulfones, and thiophosphinates), halogen compounds (e.g., chlorinated hydrocarbons), and organometallics; pour point depressants; and rust preventives, corrosion inhibitors, and defoaming agents.

EXAMPLES

The present invention will next be described in more detail by way of examples, which should not be construed as limiting the invention thereto.

Lubricating oil compositions were evaluated through the following procedure.

<SRV Friction Coefficient>

The friction coefficient of each sample oil was determined by means of a reciprocating friction tester (SRV) (product of Optimol) under the following conditions, whereby the fuel-saving performance of the sample oil was assessed.

(1) Friction pieces: (a) disk (made of SUJ2 material), (b) cylinder (made of SUJ2 material)
(2) Amplitude: 1.5 mm
(3) Frequency: 50 Hz
(4) Load: 400 N
(5) Temperature: 80° C.

Examples 1 to 5 and Comparative Examples 1 to 4

Lubricating oil compositions having a formulation given in Table 1 were freshly prepared (non-deteriorated oils). Corresponding deteriorated oils were prepared from the non-deteriorated oils. Both types of oils were evaluated in terms of friction performance. Table 1 shows the results.

The deteriorated oils were prepared through the following procedure.

<Preparation of Deteriorated Oils>

A non-deteriorated oil (100 g) was placed in a test tube and forcedly deteriorated under the following conditions, to thereby produce a corresponding deteriorated oil.

(1) Oil temperature: 140° C.

(2) Air blow: 250 mL/min (3) $NO_x$ gas blow: 100 mL/min ($NO_x$ gas: NO 8,000 ppm by mass in $N_2$)

(4) Duration of deterioration procedure: 48 hours

TABLE 1

Table 1

| | | | Examples | | | | | Comparative Examples | | | |
|---|---|---|---|---|---|---|---|---|---|---|---|
| | | | 1 | 2 | 3 | 4 | 5 | 1 | 2 | 3 | 4 |
| Formulation (mass %) | Base oil[1)] | | 83.5 | 83.2 | 82.9 | 82.9 | 82.9 | 83.5 | 83.5 | 83.2 | 83.2 |
| | Alkaline earth metal-based dispersant[2)] | | 3.5 | 3.5 | 3.5 | 3.5 | 3.5 | 3.5 | 3.5 | 3.5 | 3.5 |
| | ZnDTP[3)] | | 1.0 | 1.0 | 1.0 | 1.0 | 1.0 | 1.0 | 1.0 | 1.0 | 1.0 |
| | Succinimide[4)] | | 5.0 | 5.0 | 5.0 | 5.0 | 5.0 | 5.0 | 5.0 | 5.0 | 5.0 |
| | Phenol-based antioxidant[5)] | | 0.5 | 0.5 | 0.5 | 0.5 | 0.5 | 1.0 | — | 1.0 | — |
| | Amine-based antioxidant[6)] | | 0.5 | 0.5 | 0.5 | 0.5 | 0.5 | — | 1.0 | — | 1.0 |
| | Molybdenum amine complex[7)] | | — | 0.3 | 0.3 | 0.3 | 0.3 | — | — | 0.3 | 0.3 |
| | MoDTC[8)] | | 1.0 | 1.0 | 1.0 | 1.0 | 1.0 | 1.0 | 1.0 | 1.0 | 1.0 |
| | Viscosity index improver[9)] | | 5.0 | 5.0 | 5.0 | 5.0 | 5.0 | 5.0 | 5.0 | 5.0 | 5.0 |
| | S-containing compound A[10)] | | — | — | 0.3 | — | — | — | — | — | — |
| | S-containing compound B[11)] | | — | — | — | 0.3 | — | — | — | — | — |
| | S-containing compound C[12)] | | — | — | — | — | 0.3 | — | — | — | — |
| Effects | SRV fricton coefficient μ | Non-deteriorated oil ($\mu_1$) | 0.052 | 0.050 | 0.048 | 0.049 | 0.048 | 0.052 | 0.055 | 0.050 | 0.050 |
| | | Deteriorated oil ($\mu_2$) | 0.055 | 0.053 | 0.052 | 0.050 | 0.050 | 0.076 | 0.078 | 0.070 | 0.068 |
| | | $\Delta\mu$ ($\mu_2 - \mu_1$) | 0.003 | 0.003 | 0.004 | 0.001 | 0.002 | 0.024 | 0.023 | 0.020 | 0.018 |

[Note]

[1)]Hydrocracked mineral oil, having a kinematic viscosity (100° C.) of 4.47 $mm^2/s$, a % $C_A$ of 0, a sulfur content of 4 ppm by mass

[2)]Perbasic calcium salicylate, having a base value (determined through perchloric acid method) of 170 mgKOH/g and a Ca content of 0.61 mass %

[3)]Secondary alkyl-type zinc dialkyldithiophosphate, having a P content of 8.2 mass %

[4)]Polybutenylsuucinic acid bisimide, having a number average molecular weight of polybutenyl moiety of 1,300 and a N content of 1.7 mass %

[5)]4,4'-Methylenebis(2,6-di-tert-butylphenol)

[6)]Dialkyldiphenylamine, having a N content of 4.6 mass %

[7)]Sakura Lube 710 (product of Adeka Corporation), having a Mo content of 10 mass % and a N content of 1.3 mass %

[8)]Mo content of 4.5 mass %

[9)]Polymethacrylate, having a weight average molecular weight of resin of 300,000 (resin content: 60 mass %)

[10)]Bis(n-octoxycarbonylmethyl) disulfide

[11)]Bis(octyl thioester)phosphoric acid zinc salt

[12)]n-Octyl zinc mercaptomalate

From Table 1, the following has been found.

(1) The lubricating oil compositions (Examples 1 to 5) falling within the scope of the invention, each containing a phenol-based antioxidant, an amine-based antioxidant, and other essential ingredients, exhibited small friction coefficient $\mu_1$ in the undeteriorated state, indicating excellent fuel-saving performance. In addition, the compositions exhibited exhibited small friction coefficient $\mu_2$ in the deteriorated state, and a difference in friction coefficient between non-deteriorated oil and deteriorated oil; $\Delta\mu$ ($\mu_2$-$\mu_1$), of 0.004 or less, indicating that the fuel-saving performance can be maintained for a considerably long period of time.

In contrast, the lubricating oil compositions of Comparative Examples 1 and 3, containing no amine-based antioxidant, and the lubricating oil compositions of Comparative Example 2 and 4, containing no phenol-based antioxidant, exhibited a $\Delta\mu$ ($\mu_2$-$\mu_1$) of 0.018 to 0.024, indicating that the fuel-saving performance cannot be maintained for a sufficient period of time.

(2) The lubricating oil composition of Example 1, having a total amount of phenol-based antioxidant and amine-based antioxidant of 1.0 mass %, exhibited a $\Delta\mu$ ($\mu_2$-$\mu_1$) considerably smaller than that of the composition of Comparative Example 1 containing only a phenol-based antioxidant in an amount of 1.0 mass % and that of the composition of Comparative Example 2 containing only an amine-based antioxidant in an amount of 1.0 mass % amine-based antioxidant. Therefore, lubricating oils each containing both the phenol-based antioxidant and the amine-based antioxidant have been found to exhibit excellent fuel-saving performance that lasts for a long period of time.

INDUSTRIAL APPLICABILITY

The lubricating oil composition for internal combustion engine of the present invention exhibits excellent fuel-saving performance which is maintained for a long period of time. Therefore, the composition of the invention can be utilized as a lubricating oil composition for internal combustion engine for saving fuel and solving environmental issues, in various engines such as gasoline engines, diesel engines, alcohol (e.g., ethanol) engines, and fuel-gas engines.

The invention claimed is:

1. A lubricating oil composition, comprising:

a base oil having a kinematic viscosity as measured at 100° C. of 2 to 8 $mm^2/s$, an aromatic content (% $C_A$) of 0.5 or less, and a sulfur content of 4 ppm by mass or less;

(1) a detergent, comprising a calcium salicylate, the detergent being present in an amount of 0.3 to 1.2 mass % as reduced to sulfated ash, and the detergent having a base value of 150 to 450 mgKOH/g;

(2) a zinc dihydrocarbyldithiophosphate in an amount of 0.07 to 0.10 mass % as reduced to phosphorus;

(3) a dispersant, comprising a succinimide, in an amount of 0.05 to 0.20 mass % as reduced to nitrogen, wherein the dispersant has an alkenyl group or an alkyl group, and wherein the alkenyl group or the alkyl group has a number average molecular weight of 800 to 3,000;

(4) a first ashless antioxidant, comprising a phenol, the first ashless antioxidant being present in an amount of 0.2 to 2.0 mass %;

(5) a second ashless antioxidant, comprising an amine, the second ashless antioxidant being present in an amount of 0.2 to 2.0 mass %;

(6) a molybdenum dithiocarbamate-based friction modifier comprising, the friction modifier being present in an amount of 0.02 to 0.10 mass % as reduced to molybdenum;

wherein the molybdenum dithiocarbamate-based friction modifier is represented by formula (IV):

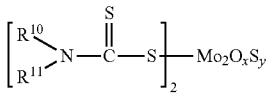

(IV)

wherein each of $R^{10}$ and $R^{11}$ represents a C4 to C24 hydrocarbyl group, each of x and y is a number of 1 to 3, and the sum of x and y is 4; and (7) optionally, a viscosity index improver in an amount of 0.02 to 6 mass % as resin amount, wherein a total amount of (4) and (5) is 0.5 to 3.0 mass %, and unit mass % is based on a total amount of the composition.

2. The lubricating oil composition as defined in claim 1, which further comprises a molybdenum amine complex in an amount of 0.1 to 5.0 mass %.

3. The lubricating oil composition as defined in claim 1, which comprises at least one sulfur-containing compound selected from the group consisting of (A), (B), and (C):

(A) a disulfide compound (a-1) represented by formula (V):

$$R^{12}OOC\text{-}A^1\text{-}S\text{—}S\text{-}A^2\text{-}COOR^{13} \quad (V),$$

wherein each of $R^{12}$ and $R^{13}$ represents, independently, a C1 to C30 hydrocarbyl group which may have an oxygen atom, a sulfur atom, or a nitrogen atom, each of $A^1$ and $A^2$ represents, independently, $CR^{14}R^{15}$ or $CR^{14}R^{15}$—$CR^{16}R^{17}$, and each of $R^{14}$ to $R^{17}$ represents independently a hydrogen atom or a C1 to C20 hydrocarbyl group, and/or a disulfide compound (a-2) represented by formula (VI):

$$R^{18}OOC\text{—}CR^{20}R^{21}\text{—}CR^{22}(COOR^{19})\text{—}S\text{—}S\text{—}CR^{27}(COOR^{24})\text{—}CR^{25}R^{26}\text{—}COOR^{23} \quad (VI),$$

wherein each of $R^{18}$, $R^{19}$, $R^{23}$, and $R^{24}$ represents, independently, a C1 to C30 hydrocarbyl group which may have an oxygen atom, a sulfur atom, or a nitrogen atom, and each of $R^{20}$ to $R^{22}$ and $R^{25}$ to $R^{27}$ represents independently a hydrogen atom or a C1 to C5 hydrocarbyl group;

(B) a reaction product between a zinc compound and a sulfur-containing phosphoric acid ester derivative represented by formula (VII):

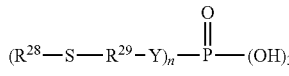

(VII)

wherein Y represents S (sulfur) or O (oxygen), $R^{28}$ represents a C4 to C24 organic group, $R^{29}$ represents a C1 to C6 divalent organic group, and n is 1 or 2; and (C) a mercaptoalkanecarboxylic acid ester zinc salt represented by formula (VIII):

$$Zn(\text{-}Sx\text{-}A^3\text{-}COOR^{30})_2 \quad (VIII),$$

wherein $R^{30}$ represents a C1 to C30 hydrocarbyl group which may have an oxygen atom, a sulfur atom, or a nitrogen atom; $A^3$ represents $CR^{31}R^{32}$, each of $R^{31}$ and $R^{32}$ represents, independently, hydrogen or a C1 to C24 hydrocarbyl group which may have an oxygen atom, a sulfur atom, or a nitrogen atom, x is an integer of 1 or 2, and two of each of $R^{30}$s, $A^3$s, and Sxs may be identical to or different from each other.

4. The lubricating oil composition as defined in claim 2, which comprises at least one sulfur-containing compound selected from the group consisting of (A), (B), and (C):

(A) a disulfide compound (a-1) represented by formula (V):

$$R^{12}OOC\text{-}A^1\text{-}S\text{—}S\text{-}A^2\text{-}COOR^{13} \quad (V),$$

wherein each of $R^{12}$ and $R^{13}$ represents, independently, a C1 to C30 hydrocarbyl group which may have an oxygen atom, a sulfur atom, or a nitrogen atom, each of $A^1$ and $A^2$ represents, independently, $CR^{14}R^{15}$ or $CR^{14}R^{15}$—$CR^{16}R^{17}$, and each of $R^{14}$ to $R^{17}$ represents independently a hydrogen atom or a C1 to C20 hydrocarbyl group, and/or a disulfide compound (a-2) represented by formula (VI):

$$R^{18}OOC\text{—}CR^{20}R^{21}\text{—}CR^{22}(COOR^{19})\text{—}S\text{—}S\text{—}CR^{27}(COOR^{24})\text{—}CR^{25}R^{26}\text{—}COOR^{23} \quad (VI)$$

wherein each of $R^{18}$, $R^{19}$, $R^{23}$, and $R^{24}$ represents, independently, a C1 to C30 hydrocarbyl group which may have an oxygen atom, a sulfur atom, or a nitrogen atom, and each of $R^{20}$ to $R^{22}$ and $R^{25}$ to $R^{27}$ represents independently a hydrogen atom or a C1 to C5 hydrocarbyl group;

(B) a reaction product between a zinc compound and a sulfur-containing phosphoric acid ester derivative represented by formula (VII):

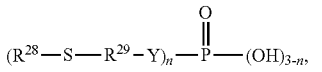

(VII)

wherein Y represents S (sulfur) or O (oxygen), $R^{28}$ represents a C4 to C24 organic group, $R^{29}$ represents a C1 to C6 divalent organic group, and n is 1 or 2; and (C) a mercaptoalkanecarboxylic acid ester zinc salt represented by formula (VIII):

$$Zn(\text{-}Sx\text{-}A^3\text{-}COOR^{30})_2 \quad (VIII),$$

wherein $R^{30}$ represents a C1 to C30 hydrocarbyl group which may have an oxygen atom, a sulfur atom, or a nitrogen atom, $A^3$ represents $CR^{31}R^{32}$, each of $R^{31}$ and $R^{32}$ represents, independently, hydrogen or a C1 to C24 hydrocarbyl group which may have an oxygen atom, a sulfur atom, or a nitrogen atom, x is an integer of 1 or 2, and two of each of $R^{30}$s, $A^3$s, and Sxs may be identical to or different from each other.

5. The lubricating oil composition as defined in claim 1, wherein the first ashless antioxidant is at least one of a bisphenol-based antioxidant and an ester group-containing phenol-based antioxidant wherein the bisphenol and the phenol may be substituted with one or more hydrocarbyl groups having from 1 to 9 carbon atoms.

6. The lubricating oil composition as defined in claim 5, wherein the substituent having from 1 to 9 carbon atoms is at least one selected from the group consisting of a methyl group, a butyl group, and a nonyl group.

7. The lubricating oil composition as defined in claim 1, wherein the first ashless antioxidant comprising a phenol is at least one compound selected from the group consisting of 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,4-dimethyl-6-tert-butylphenol, 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl) sulfide, bis(3,5-di-tert-butyl-4-hydroxybenzyl) sulfide, 2,2'-thio-diethylenebis[3-(3,5-di-tert-butyl-4-hydroxyphenyl) propionate], tridecyl-3-(3,5-di-tert-butyl-4-hydroxyphenyl) propionate, pentaerythrityl-tetrakis[3-(3,5-di-tert-butyl-4-hydroxyphenyl) propionate], octyl-3-(3,5-di-tert-butyl-4-hydroxyphenyl) propionate, octadecyl-3-(3,5-di-tert-butyl-4-hydroxyphenyl) propionate, and octyl-3-(3-methyl-5-tert-butyl-4-hydroxyphenyl) propionate.

8. The lubricating oil composition as defined in claim 1, wherein the second ashless antioxidant comprising an amine is one or more alkylated diphenylamines having a C3 to C20 alkyl group.

9. The lubricating oil composition as defined in claim 1, wherein the second ashless antioxidant comprising an amine is at least one compound selected from the group consisting of diphenylamine, monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine, and tetranonyldiphenylamine.

10. The lubricating oil composition as defined in claim 1, wherein the second ashless antioxidant comprising an amine is 4,4'-di(C3 to C20 alkyl)diphenylamine.

11. The lubricating oil composition as defined in claim 1, wherein each of $R^{10}$ and $R^{11}$ represents a C7 to C24 hydrocarbyl group.

12. The lubricating oil composition as defined in claim 1, wherein each of $R^{10}$ and $R^{11}$ represents an alkyl group selected from the group consisting of an octyl group, a decyl group, a dodecyl group, and a tetradecyl group.

13. The lubricating oil composition as defined in claim 1, wherein each of the molybdenum dithiocarbamate-based friction modifier is at least one selected from the group consisting of molybdenum sulfide diethyldithiocarbamate, molybdenum sulfide diproyldithiocarbamate, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, molybdenum sulfide ditridecyldithiocarbamate, molybdenum sulfide di(butylphenyl)dithiocarbamate, molybdenum sulfide di(nonylphenyl) dithiocarbamate, molybdenum oxysulfide diethyldithiocarbamate, molybdenum oxysulfide dipropyldithiocarbamate, molybdenum oxysulfide dibutyldithiocarbamate, molybdenum oxysulfide dipentyldithiocarbamate, molybdenum oxysulfide dihexyldithiocarbamate, molybdenum oxysulfide dioctyldithiocarbamate, molybdenum oxysulfide didecyldithiocarbamate, molybdenum oxysulfide didodecyldithiocarbamate, molybdenum oxysulfide ditridecyldithiocarbamate, molybdenum oxysulfide di(butylphenyl) dithiocarbamate, and molybdenum oxysulfide di(nonylphenyl)dithiocarbamate.

14. The lubricating oil composition as defined in claim 1, wherein the viscosity index improver is at least one polymer selected from the group consisting of a polymethacrylate, a styrene-isoprene copolymer, and an ethylene-α-olefin copolymer each having a weight average molecular weight of 150,000 to 600,000.

15. The lubricating oil composition as defined in claim 1, wherein the base oil has an aromatic content (% CA) of 0.

16. The lubricating oil composition as defined in claim 1, comprising the viscosity index improver in an amount of 0.02 to 6 mass % as resin amount.

* * * * *